United States Patent [19]

Donovan

[11] 4,450,752

[45] May 29, 1984

[54] GAS OPERATED AUTOMATIC WEAPON

[76] Inventor: John S. Donovan, 16503 Santa Rosa, Detroit, Mich. 48221

[21] Appl. No.: 220,539

[22] Filed: Dec. 29, 1980

Related U.S. Application Data

[60] Continuation of Ser. No. 47,464, Jun. 11, 1979, abandoned, which is a division of Ser. No. 874,114, Feb. 1, 1978, Pat. No. 4,210,060, which is a continuation-in-part of Ser. No. 829,716, Sep. 1, 1977, abandoned.

[51] Int. Cl.[3] ..... F41D 11/02

[52] U.S. Cl. ..... 89/142; 89/143

[58] Field of Search ..... 89/140, 142, 143

[56] References Cited

U.S. PATENT DOCUMENTS

| | | | |
|---|---|---|---|
| 1,350,961 | 8/1920 | Farquhar et al. | 89/143 |
| 2,388,443 | 11/1945 | Ruger | 89/143 |
| 3,776,096 | 12/1973 | Donovan | 89/142 |

*Primary Examiner*—Stephen C. Bentley

*Attorney, Agent, or Firm*—John R. Benefiel

[57] ABSTRACT

A belt-fed, gas-operated automatic weapon of a type in which the gas pressure developed in the barrel bore during firing is ported just forward of the barrel chamber to be utilized to compress a system of opposing spring sets which in turn operate the various mechanisms involved in the automatic or semi-automatic functioning of the weapon, including ammunition feeding and ejection, bolt locking and unlocking, and reciprocation. Dual power cylinders with symmetrically arranged pistons operated by the gas pressure compress all of the springs in the opposing spring sets by engagement with a sliding carriage. The forces exerted on the bolt locking mechanism by the spring sets are greatly reduced during the interval in which the locking mechanism is operated to reduce wear on the mating surfaces and to properly sequence the unlocking after discharging a round. Manual actuation of the weapon is also enabled with an automatic latching of the bolt in the retracted position upon manual actuation and also upon full depression of a selector lever and release of the trigger during automatic fire such that the bolt remains in the retracted position upon cessation of fire to allow cooling of the breech and/or feeding of a fresh ammunition belt. A particular interlinked ammunition belt is disclosed to advance rounds carried by the belt through the weapon as well as an arrangement for separating each link from the belt after passing through the weapon.

2 Claims, 26 Drawing Figures

FIG. 25
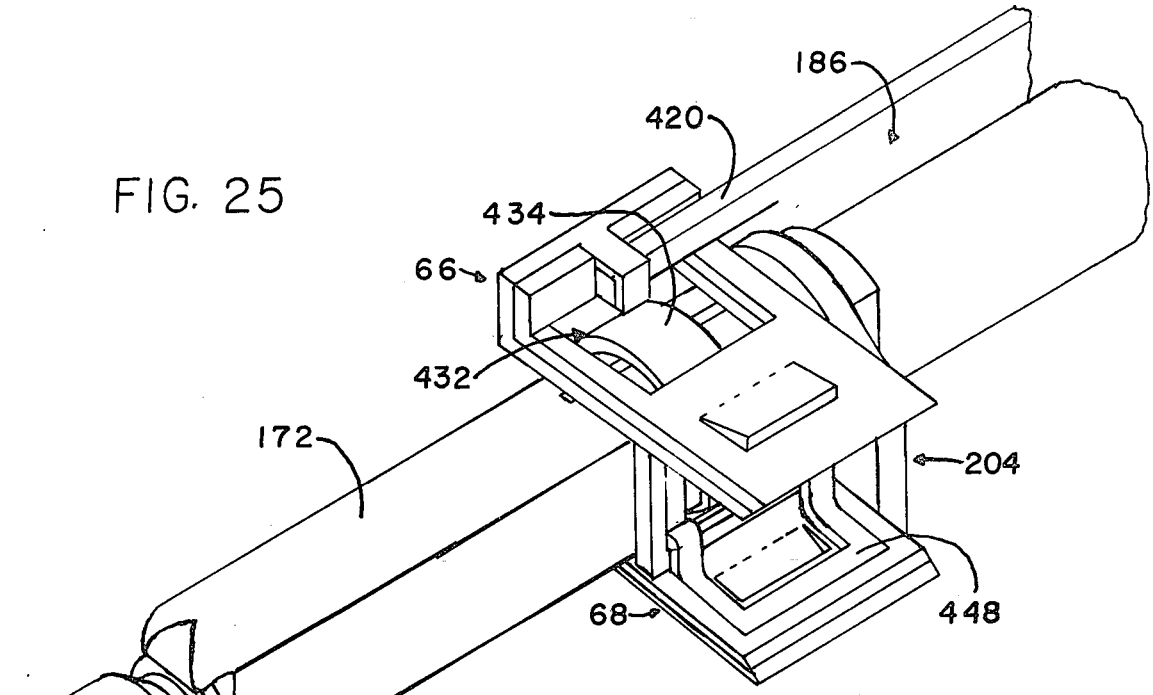
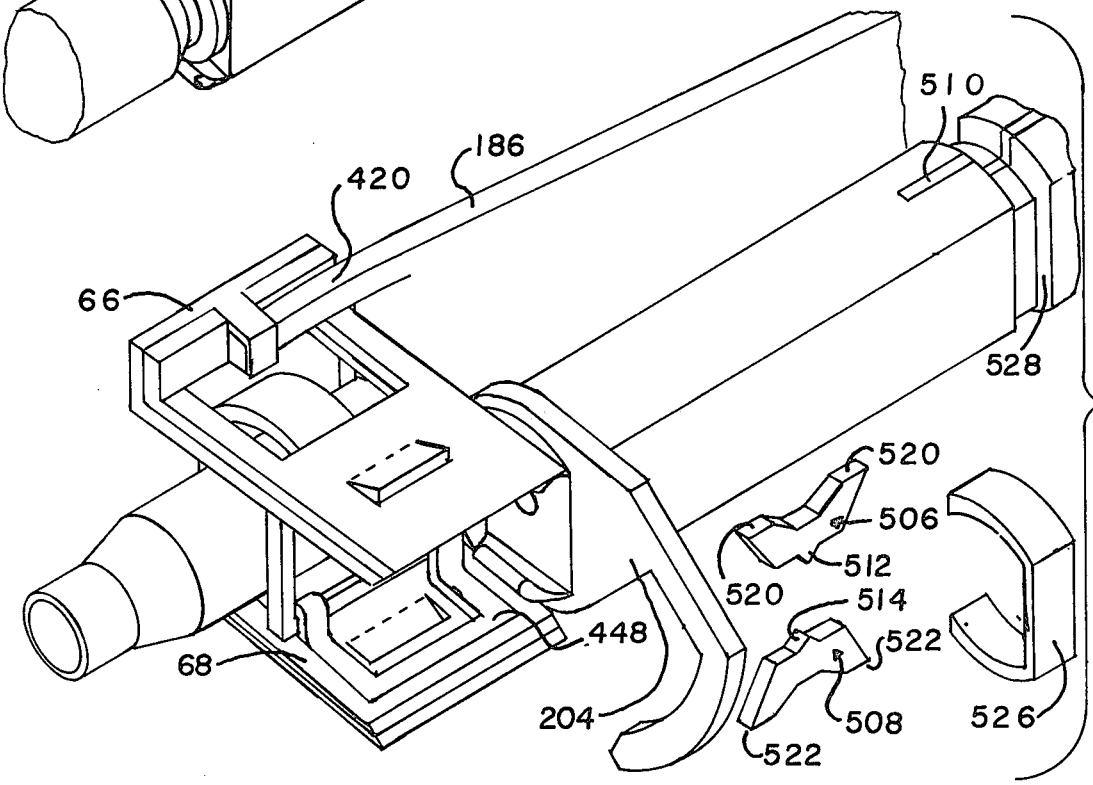
FIG. 26

GAS OPERATED AUTOMATIC WEAPON

CROSS REFERENCE TO RELATED APPLICATIONS

This application is a continuation of Ser. No. 06/047,464, filed 6-11-79, now abandoned; which was a division of Ser. No. 05/874,114, filed 2-1-78, now U.S. Pat. No. 4,210,060; which was a continuation-in-part of Ser. No. 05/829,716, filed 9-1-77, now abandoned.

BACKGROUND OF THE INVENTION

1. Field of the Invention

This invention concerns automatic weapons and more particularly is concerned with improvements in gas-operated automatic weapons.

2. Description of the Prior Art

Infantry squad, platoon and company level operations normally require to varying degrees the fire power of fully automatic weapons with rates of fire as is presently afforded by the belt-fed, tripod-mounted machine guns. The fully automatic capability of the basic shoulder weapon of many modern day military organizations does not satisfactorily fulfill this requirement since these weapons are generally magazine fed and cannot provide this level of fire power. In addition, these weapons generally are not effective in the fully automatic mode of fire since the rates of fire and the design of these particular weapons is such that it is impossible to effectively direct the fire after the initial few rounds.

The belt-fed, tripod-mounted machine gun, while suitable for defensive situations, is ill-adapted to assault or offensive operations due to their weight and bulk even when refitted for shoulder fire. Furthermore, the use of such weapons is complicated from a military logistics standpoint since these weapons are only issued on an organizational unit basis, i.e., each company or platoon is issued a predetermined number of such weapons and a limited number of trained gunners are assigned to each unit. This creates a logistics problem since the need for such automatic weapon fire power varies with the given tactical situation.

It would thus be advantageous if such automatic weapons capability could be afforded to each infantry unit on a more flexible basis and such logistics and organizational problems could be eliminated.

Such capability could be provided by a shoulder-fired, belt-fed semi-automatic weapon which was light in weight and could be fired with sufficient accuracy such that such weapons could be issued to each infantryman at the squad level as the basic weapon, with a ready conversion to automatic firing providing a tremendous enhancement of the fire power of the infantry unit.

Such a firearm would necessarily be required to meet certain additional essential or highly desirable design criteria for military weaponry. For example, such weapons must be very reliable and readily field stripped in order to correct any malfunctioning which may occur without the use of tools. An example of a highly desirable feature is a capability for right or left handed firing of the weapon in many military operations, particularly in operations conducted through urban areas. That is, the feeding of belt-carried ammunition should be able to be done from either side since the tactics of the situation often involve firing from concealed positions against a building wall on either side of the street.

In U.S. Pat. Nos. 3,776,096 and 3,853,035, both issued to the present inventor, is disclosed such a shoulder-fired automatic weapon which is gas-operated as are many such automatic weapons. However, in the design disclosed therein, the gas porting is located just ahead of the barrel chamber such that relatively high pressure gas is utilized to operate the various mechanism to obtain advantages over those conventional designs which are operated by gas pressure ported at the forward point along the weapon barrel. The major drawback of the conventional designs is that they necessitate long operating rods extending forward to the gas port, increasing the bulk and weight of the weapon and adversely affecting its balance characteristics.

This specific advantage of the design disclosed in those patents is afforded without the necessity for the use of gas pressure accumulator devices to reduce excessive forces which would otherwise be created by a unique concept in which the sequencing of operation is not carried out directly by the movement of an operating rod, but rather there is provided a sequential operation of the associated automatically operated mechanisms which are operated by means of opposing sets of springs in turn compressed by means of the gas pressure applied to pistons such that the accumulator mechanisms are not necessitated. All of the operating components thereby may be located to the rear of the weapon, and the resulting weapon is of relatively light weight and of excellent balance. It is thus rendered suitable for issuance to infantrymen as the basic shoulder-fired weapon, while affording the fire power inherent in a belt-fed fully automatic firearm.

In this design, as in any firearm, it would of course be desirable to reduce the deflections and stresses produced in the various operating parts so as to enable minimization of the size and mass of the various components to further enhance the handling advantages of the design.

While a dual piston operating rod assembly for a gas-operated automatic firearm is disclosed in U.S. Pat. No. 3,999,461, this weapon design involves a forwardly located gas port requiring a significant mass of the weapon to lie forward of the receiver of the weapon, leading to the aforementioned disadvantages. In addition, each of the piston members performs different functions in the operation of the weapon such that true symmetry and balancing of forces is not achieved, albeit some reduction in the stress levels exerted on the components is achieved.

The manual actuation of the weapon disclosed in the above-cited patents to the present inventor is relatively cumbersome and it would likewise be advantageous to simplify the manipulations required in executing a manual actuation of the weapon.

The weapon disclosed in those patents also produces a relatively high pressure sliding movement by virtue of the design features wherein the bolt is locked during firing by means of an oscillating bolt latch element, which is operated to release the bolt while the bolt was urged to retract under heavy pressure by a compressed spring in the opposing spring system. This arrangement obviously would produce a wear point in the mechanism, and it would be advantageous if such pressure could be relieved at least partially during the cycling of the bolt latch element.

Another capability which would be desirable in such weaponry is the automatic retention of the bolt in its fully retracted position during manual operation and also after the cessation of automatic fire, since this allows the ammunition belt to be removed from the breech, a fresh belt to be inserted, or to leave the breech clear to free a jammed cartridge, or to allow cooling of the chamber.

Accordingly, it is an object of the present invention to provide an improvement to the automatic weapon of the type described in the aforementioned U.S. Patents to the present inventor in which the forces impressed on the components by the gas pressure is both balanced and reduced so as to reduce the stresses and deflections imposed on the various components to enable the weight of the moving parts to be reduced.

It is another object of the present invention to reduce the pressure exerted on the bolt latching element and mating bolt and receiver surfaces as the unlatching movement is executed.

It is yet another object of the present invention to simplify the manual actuation of the automatic weapons described to allow a simple stroking actuation.

It is still another object of the present invention to provide such an automated weapon in which the bolt may be automatically latched to the fully retracted position either after manual actuation or selectively upon cessation of automatic fire.

It is still another object of the present invention to provide certain other design improvements to the gas-operated automatic weapon described in the above-cited patents to certain of the mechanical components as will be described hereinafter.

These objects are to be achieved while enabling assembly for either right or left hand ammunition feed and without compromising any of the advantages of the basic design.

SUMMARY OF THE INVENTION

These and other objects, which will become apparent upon a reading of the following specification and claims, are accomplished by the provision of dual piston cylinder assemblies which are vertically spaced and symmetrically located with respect to the bolt axis. Each of the piston cylinders communicates with a respective port in the barrel just forward of the barrel chamber and transmits the gas pressure generated to the pistons. Both of the pistons acts on a centrally mounted slidable carriage which acts to receive the forces produced by the pistons. The slidable carriage in turn transmits the forces into the spring system which operates the bolt locking and unlocking mechanism and also reciprocates the bolt through the extraction and ram motions. The forces existing between the oscillating bolt latch element and the bolt are reduced during the unlocking of the bolt by an arrangement in which the rearward force exerted on the bolt by the gas pressure in the barrel compresses a high energy spring after the bolt extraction spring is compressed, with the sudden reduction of forces occurring after the barrel pressure abates. This allows the high energy spring to relax, the extracting force acting on the bolt by the bolt extracting system momentarily being reduced thereby, which then reexerts its force on the bolt to cause the bolt to move rearwardly after unlocking of the bolt which occurs during the interval of reduced bolt force. Manual actuation is executed by a simple stroking of a manual actuating slider, with the sequencing of the bolt unlocking and extraction movement by the manual actuator being arranged so as to allow the simplified manual actuation movement.

Also provided is a bolt latch which automatically retains the bolt in the retracted position upon manual actuation or selectively upon cessation of automatic mode of fire by release of the weapon trigger and manipulation of the selector lever such as to allow the receiver breech opening to be clear of the bolt. An interlinked ammunition belt is provided which allows the link centered feeding of cartridges into the chamber, which does not depend on the presence of a cartridge in the link to maintain the assembly of the links and which limits the relative pivotal movement between links to insure proper cooperation with the belt feed. After feeding the successive round into the receiver, an arrangement operated by the bolt causes separation of the link from the belt assemblage which has advanced the previous round beyond the bolt.

DESCRIPTION OF THE DRAWINGS

FIG. 25 is a perspective view of the weapon components with the feed trays shown in their position during firing of a round.

FIG. 26 is a perspective view of the weapon components engaging the feed trays during feeding of the ammunition belt engaged throgh the receiver.

DETAILED DESCRIPTION

In the following detailed description, certain specific terminology will be utilized for the sake of clarity and a specific embodiment described in accordance with the requirements of 35 USC 112, but it is to be understood that the same is not intended to be limiting and should not be so construed inasmuch as the invention is capable of taking many forms and variations with the scope of the appended claims.

Figure 1:
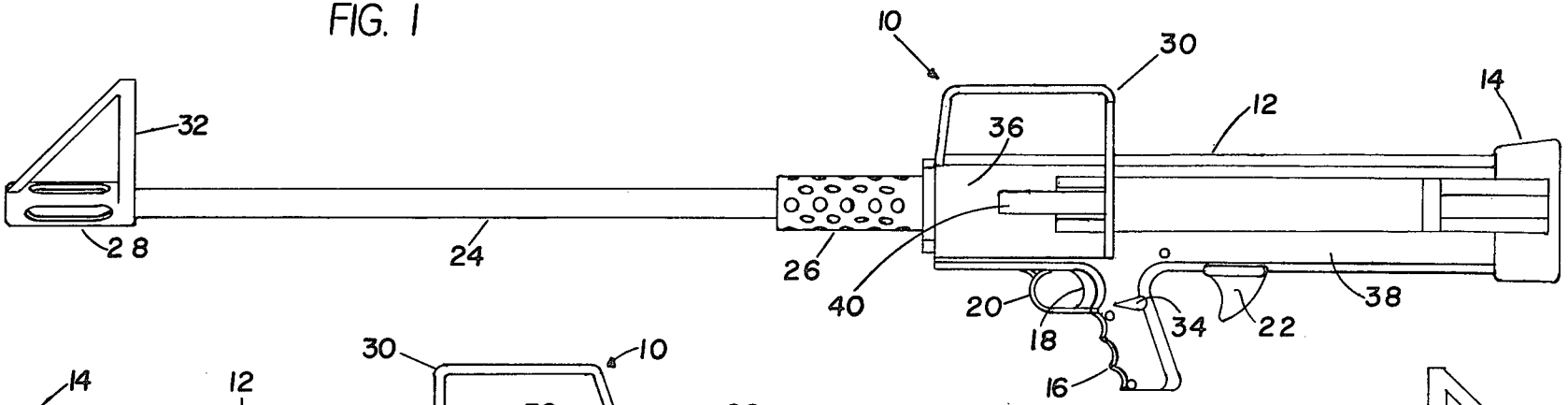
FIG. 1 is a side elevational view of the automatic weapon according to the present invention.
Figure 2:
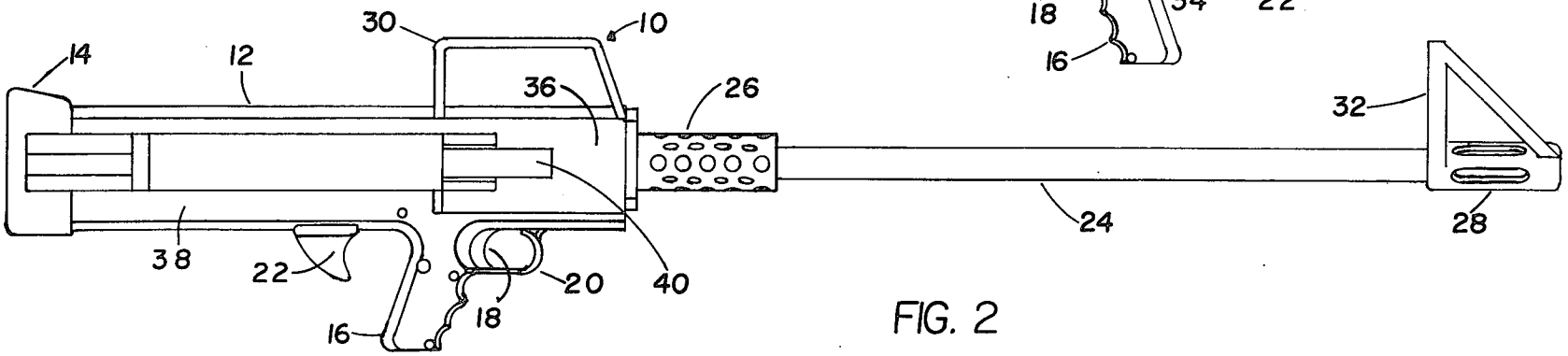
FIG. 2 is the reverse side elevational view of the automatic weapon shown in FIG. 1.

Referring to FIGS. 1 and 2, the basic external configuration of the automatic weapon 10 according to the present invention can be seen and includes a housing 12 which encloses the weapon, including a butt 14 adapted to engage the shoulder of the firer. A hand grip 16 is provided, as is a trigger 18 and a trigger guard 20.

A manual actuation slider 22 is provided for manually cycling the operating mechanism, the slider 22 disposed for sliding movement along the bottom of the housing 12.

The barrel 24 extends forwardly from the housing 12 and is equipped with a heat shield 26 adapted to protect the firer from the high temperature portion of the barrel 24 in the vicinity of the firing chamber as well as to aid in dissipation of the heat. A flash suppressor 28 is provided at the forward end of the barrel 24, while the rear sight bracket 30 and a front sight 32 are also provided. Other conventional accessories such as carrying straps, bipod mounts, etc. are not shown, but the weapon would normally be equipped or adapted to be equipped for such standard military accessories.

A selector lever 34 is provided which is used to selectively cause the weapon to fire in the automatic or the semi-automatic mode and further acts as a safety depending on the rotative position and also allows by proper positioning of the selector lever 34 that the bolt may be retained in the rearward position upon cessation of automatic fire.

The housing 12 is comprised of two cover plates of formed sheet metal, an upper-forward cover plate 36 generally extending over the top portion of the housing 12 and a rear lower cover 38 similarly formed of sheet metal, with the upper front cover 36 and the lower rear cover 38 abutting each other along and lower portion of the housing 12, forward of the trigger guard 20. The lower rear cover also is formed in the hand grip 16 as best seen in FIGS. 8 and 9.

Figures 3, 4, 5:
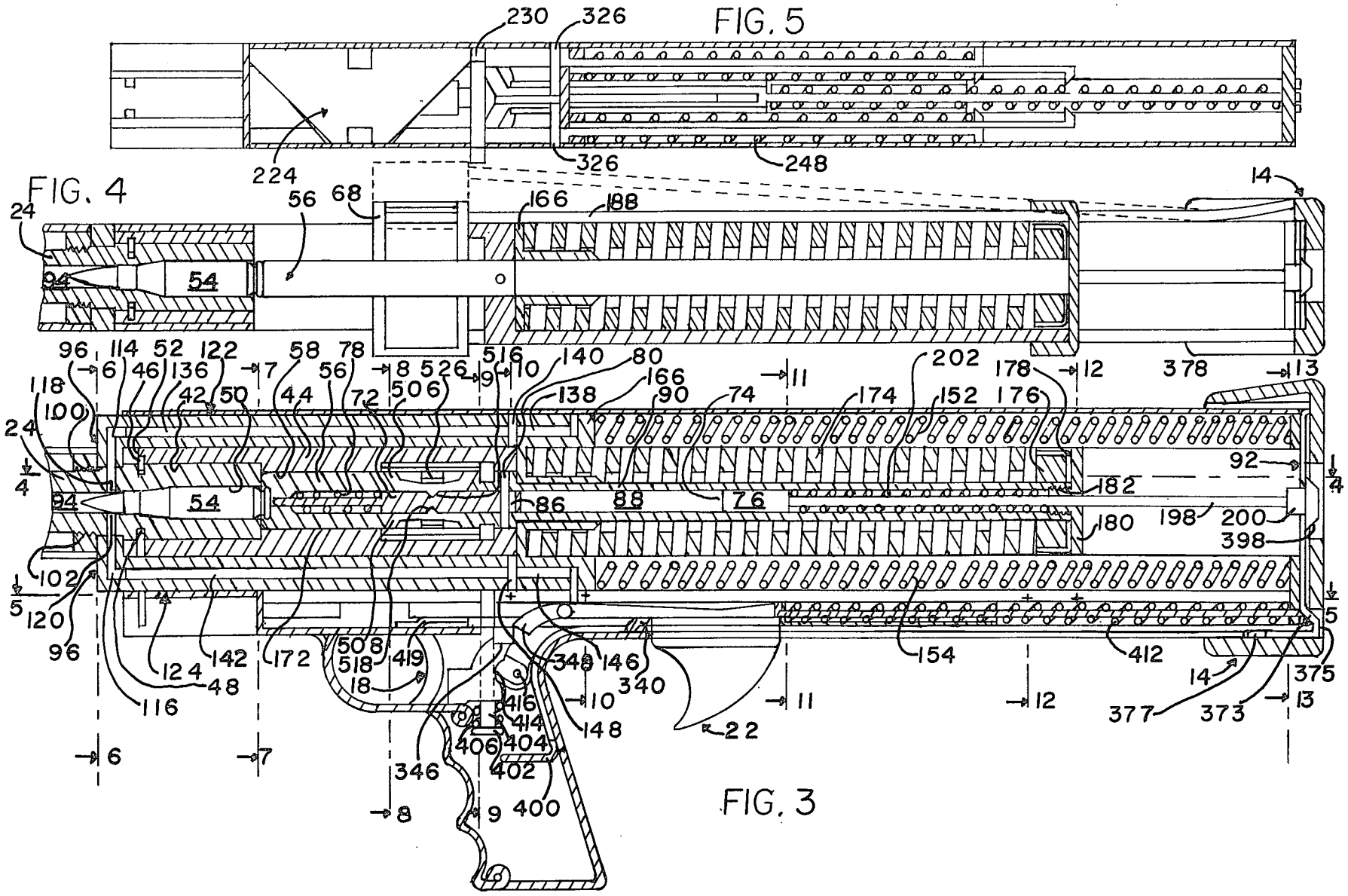
FIG. 3 is a longitudinal partially sectional view of the automatic weapon shown in FIGS. 1 and 2 shown with the forward sections of the barrel broken away.
FIG. 4 is a horizontal sectional view of the line 4—4 in FIG. 3.
FIG. 5 is a horizontal sectional view taken through the plane represented by the line 5—5 in FIG. 3.

Barrel 24 is assembled into a barrel housing bore 42 formed in a receiver frame 44 as best in FIG. 3 with a snap ring retainer 46 seated in a recess 48 machined around the outside diameter of the barrel 24 in the region of the chamber 50. The snap ring retainer 46 locates an end face 52 of the receiver frame 44 to retain the barrel 24 within the bore 42. The barrel chamber 50 is machined in the conventional fashion to receive a cartridge 54 shown seated in the chamber 50. A cartridge 54 is locked in position within the chamber 50 by means of a bolt assembly 56 slidably disposed in a bore 58 also formed in the receiver frame 44.

The bolt assembly 56 functions in a broadly conventional manner to securely position the cartridge 54 in position during firing when the bolt 56 is locked in the position shown in FIG. 3 by a bolt locking mechanism to be described. This allows the bolt assembly 56 to absorb the heavy forces generated by the gas created by firing of the cartridge 54, which pressures persist until the bullet passes entirely out of the barrel 24, allowing the gases to vent.

Figures 6, 7, 8, 9:
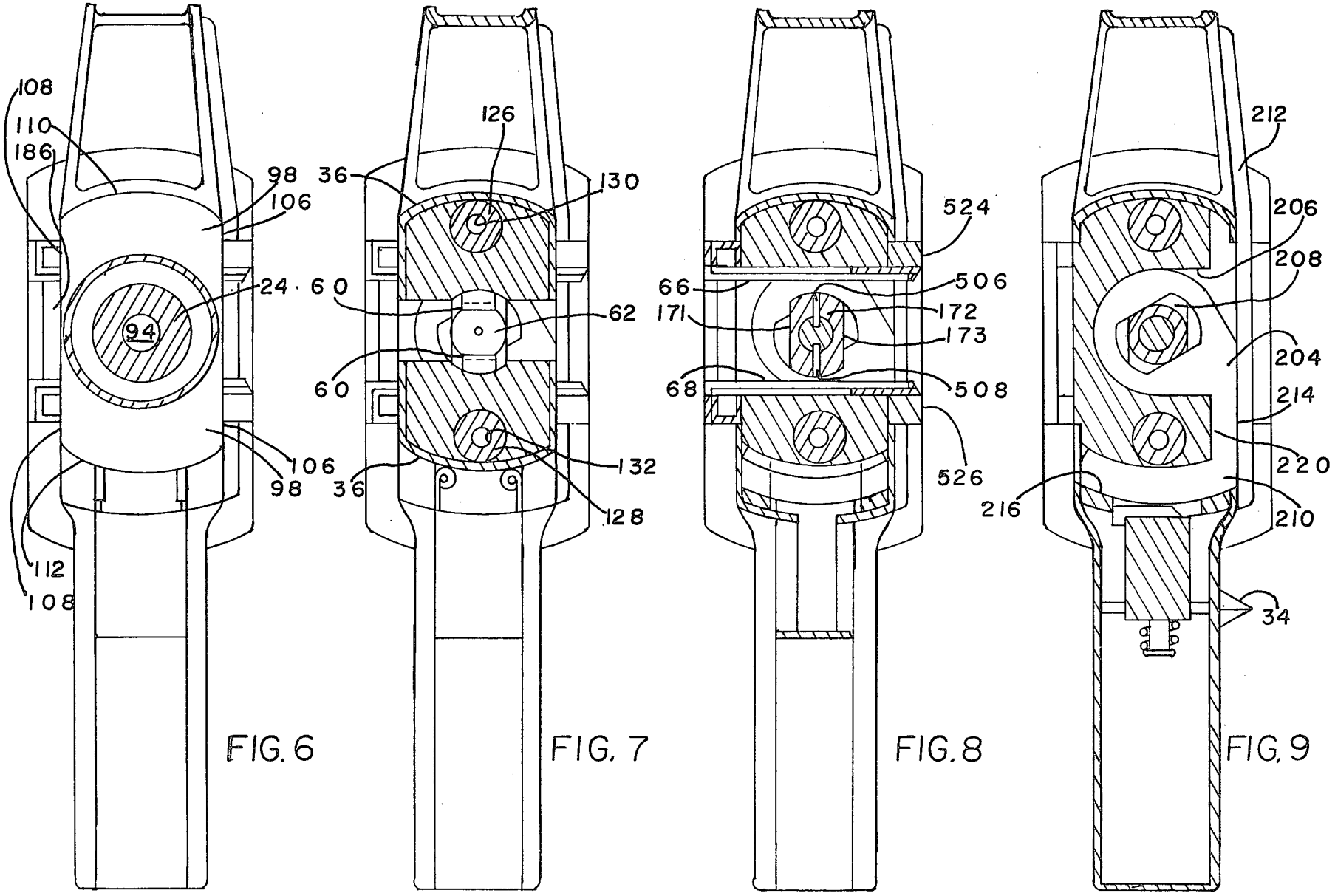
FIG. 6 is a view of the section 6—6 taken as indicated in FIG. 3.
FIG. 7 is a view of the section 7—7 taken as indicated in FIG. 3.
FIG. 8 is a view of the section 8—8 taken as indicated in FIG. 3.
FIG. 9 is a view of the section 9—9 taken as indicated in FIG. 3.

The bolt assembly 56 also engages the cartridge 54 to ram each round of ammunition into the chamber 50 as well as to extract the expended shell casing after firing by means of a pair of grooves 60 recessed into the bolt face 62 (FIG. 7). Each cartridge 54 is adapted to be fed into the receiver frame 44 through a breech opening 40 (FIG. 1), when the bolt 56 is in the retracted position as will be described by means of a pair of ammunition feed trays 66 and 68 which in turn are reciprocated by means of feed mechanisms also to be described herein. The cartridges 54 are carried by an interlinked ammunition belt into the breech opening 40 (FIG. 1) on the trays 66 and 68 with the expended shell casing being again placed within the links of the ammunition belt and fed out of the receiver through a breech opening 40 (FIG. 2) in the receiver frame 44.

A centrally disposed firing pin 72 is also provided which is positioned within a central opening in the bolt 56, arranged so as to impact the primer of the cartridge 54 in the conventional manner upon being struck by the impacting of the head 74 of a hammer mechanism 76, triggering being controlled differently in the automatic firing than in semi-automatic firing modes as will be described hereinafter.

The firing pin 72 is returned to its initial position after firing by means of a return spring 78 with a pin connection 80 being provided passing through a perpendicular bore in the rear shank of the firing pin, the clearance space 86 being provided to allow forward movement of the firing pin 72 upon impact of the hammer head 74, but insuring that the firing pin 72 is moved with the bolt assembly 56 during its movement in cycling of the weapon mechanisms.

The hammer head 74 passes down through a long bore 88 formed in a rear extension portion 90 integral with the bolt 56, the hammer head portion 74 being slidably disposed in the rear portion of the interior bore 88 as shown in FIG. 3.

The release of the hammer 76 is controlled by a sear mechanism 92 located within the rifle butt 14 which sear mechanism was described in the above-cited patents, but for the same of completeness, the details of this mechanism will be described herein.

According to the concept of the present invention, the various mechanism arrangement of parts required for ammunition feeding, bolt locking and unlocking and the bolt movements required for extraction, and ramming of each round into and out of the barrel chamber, respectively, are operated by means of a gas pressure generated in the rifled bore 94 of the barrel 24 by burning of the cartridge charge after ignition by the cartridge primer. This gas pressure is converted into a mechanical force by means of a dual power cylinder assembly 96 (FIG. 3) which includes a manifold end plate 98 (FIG. 6) slidably disposed over the outside of the barrel 24, seated on a shoulder 100 (FIG. 3) and retained thereon by means of a threaded ring 102 threaded onto a threaded portion machined around the barrel 24 as shown in FIG. 3. The manifold end plate 98 (FIG. 6) is formed with flattened sides 106 and 108 with partially circular upper and lower contours 110 and 112, which are in conformity with the exterior lines of the upper and lower surface of the cover 36 (FIG. 7).

The dual power cylinder assembly 96 (FIG. 3) also includes a pair of oppositely located radially directed bores 114 and 116 which are in registry with the corresponding pair of radial ports 118 and 120 extending from the rifled bore 94 just ahead of the barrel chamber 50 to provide a means for communicating the high pressure gases generated by firing of the cartridge 54 to a pair of piston and cylinder assemblies 122 and 124. Each piston and cylinder assembly 122 and 124 is located with opposite locations on either side of the center line of the barrel 24 so as to be vertically spaced when the automatic weapon 10 is held. This vertical spacing is in general conformity with the shape of the housing 12, the width of the automatic weapon 10 thus being in keeping with easy gripping of the same during firing.

The upper piston cylinder assembly 122 (FIG. 7) includes an upper cylinder tube 126 having a bore 130 while the lower cylinder tube 128 includes a bore 132.

Slidably disposed in the upper cylinder tube 126 and bore 130 is a piston (FIG. 3) comprised of a front piston section 136 integral with a locating stem 138 and an intermediate skirt portion 140. The lower portion and cylinder assembly 124 include a piston which has a front piston portion 142 slidably disposed in the bore 132, integral with the locating stem 146 and an intermediate skirt portion 148. Each of the locating stems 138 and 146 are received within bores 156 and 158 (FIG. 18) formed in a carriage member 150 (FIG. 18) upon which thereby acts the force generated by the gas pressure acting on the front face of the front piston portions 136 and 142. The skirt portions 140 and 148 are of greater diameter than the front piston portions 136 and 142 and the locating stems 138 and 146 of the pistons, and they thus act on the forward face of the carriage 150 to provide a stop during forward travel of the pistons, under the influence of a pair of carriage return springs 152 and 154 and during rearward stroking of the pistons acting to transfer the force applied to the pistons into the carriage member 150.

The symmetrical arrangement of the power cylinders 122 and 124 minimizes the distortion imposed on the various moving components since the forces generated are thereby balanced in the sense that they impose no distorting bending forces on the components. In addition, the stress levels are reduced since the necessary are of course carried by two separate piston and cylinder assemblies and are received in oppositely spaced locations on the carriage member 150.

Due to the complexity of the various components involved, the description of various portions of the mechanisms will be carried out in functionally related groupings, these functions being the Bolt Actuation, Bolt Locking, Trigger and Selector, and Ammunition Feed. These groupings being along functional lines, certain individual components are common to more than one of the various groupings, but considering each of these separately aids in arriving at an understanding of the complete operation and design of the weapon according to the present invention.

BOLT ACTUATION

Figures 10, 11, 12, 13, 14, 15, 16, 17:
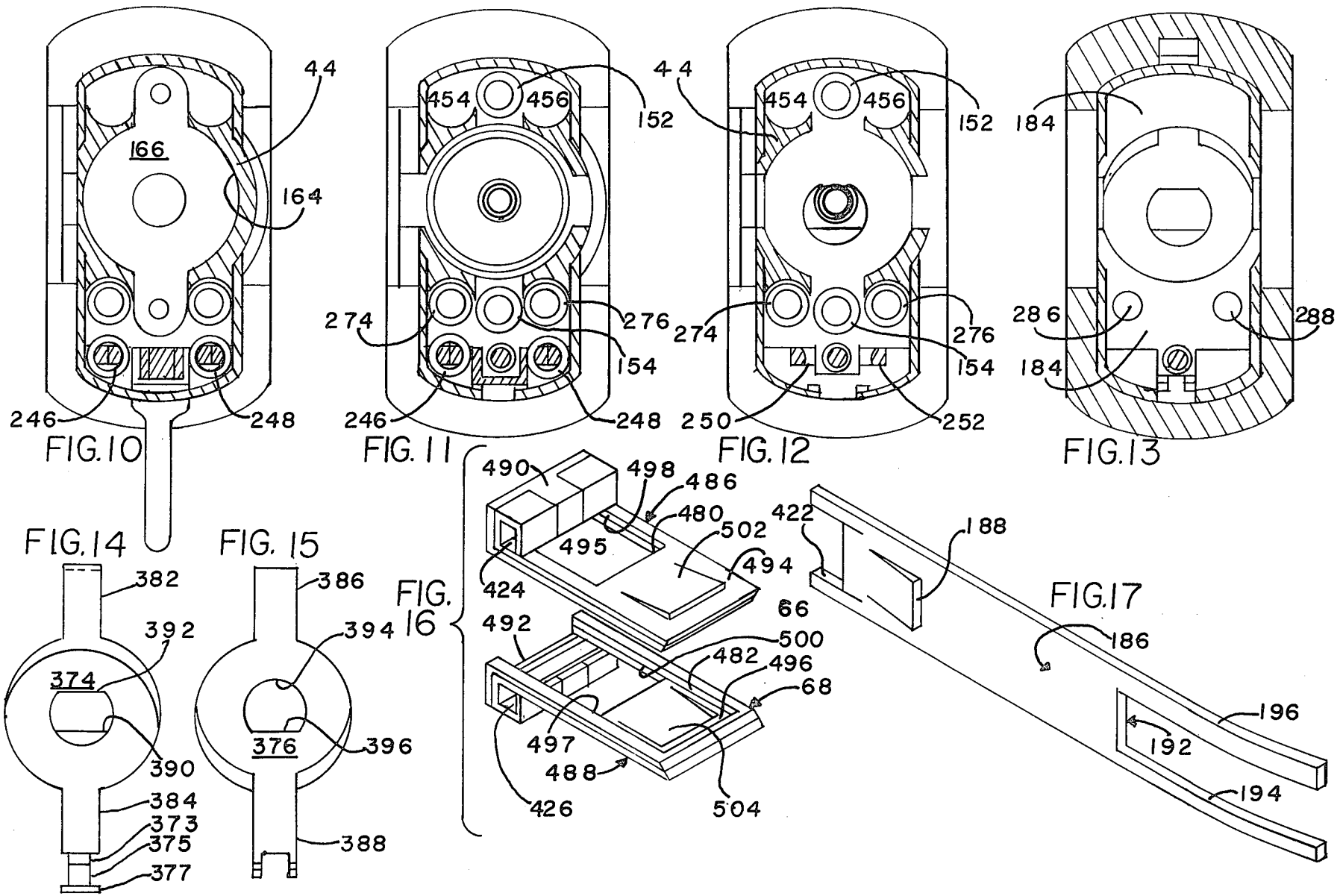
FIG. 10 is a view of the section 10—10 taken as indicated in FIG. 3.
FIG. 11 is a view of the section 11—11 taken as indicated in FIG. 3.
FIG. 12 is a view of the section 12—12 taken as indicated in FIG. 3.
FIG. 13 is a view of the section 13—13 taken as indicated in FIG. 3.
FIGS. 14 and 15 are frontal views of the sliding sear plate mechanism incorporated in the automatic weapon showing alternate operating positions of the sliding sear plates.
FIG. 16 is a perspective view of the upper and lower feed trays utilized to advance the interlinked ammunition belt into the breech.
FIG. 17 is a perspective view of the feed spring carriage latch member incorporated in the automatic weapon according to the present invention.
Figure 18:
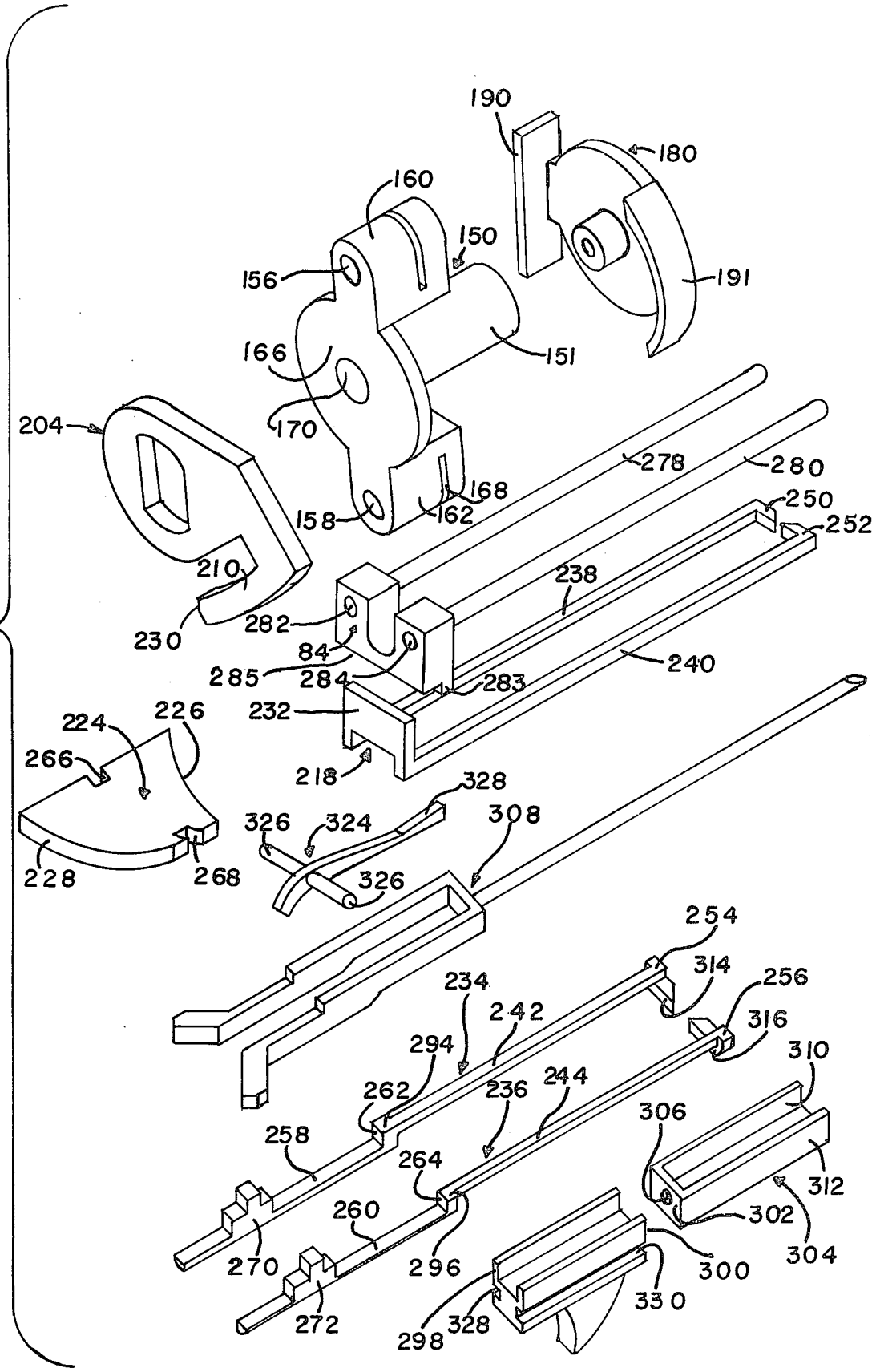
FIG. 18 is an exploded perspective view of the various operating components associated with the operation of the bolt locking and unlocking.

In bolt actuation, the bolt assembly 56 is moved to the rear to extract a fired cartridge casing from the barrel chamber 50, allow the ejection of the spent casing from the breech, and the introduction of a fresh round into the breech. Finally, the bolt assembly 56 is moved forward to ram the fresh round into the barrel chamber 50. This movement is carried out by means which includes the carriage 150 and, as described above, the carriage 150 is adapted to be driven towards the rear by the power cylinder assemblies 122 and 124, by virtue of the locating stem 138 and 146 of each of the pistons being slidably received in bores 156 and 158 formed in carriage ear portions 160 and 162, as best seen in FIG. 18. The carriage 150 is slidably disposed within the receiver frame 44, the receiver frame 44 being provided with an interior opening 164 which is adapted to receive the sliding carriage as seen in FIG. 10. The carriage 150 is also formed with a central annular plate section 166 which has a central bore 170 (FIG. 18) through which is adapted to be passed the rear bolt extension portion 90. A carriage guide tube 151 is secured to the rear face of the carriage 150 and extends rearwardly a short distance, slidably mounted on the rear extension portion 90 of the bolt assembly 56 to prevent canting of the carriage 150 during relative sliding movements thereof.

The bolt assembly 56 has a forward section 172 (FIG. 8) which has a cross-sectional shape in which a pair of flat surfaces 171 and 173 are machined on the sides thereof which prevent the bolt from rotating in the bolt sliding track 58 formed in the receiver frame 44. The central bore 170 in the carriage 150 is of a size so as to receive bolt rear extension portion 90 and provides an abutment as shown in FIG. 3 for the shoulder formed between the bolt rear extension portion 90 and the forward bolt section 172 so as to provide a driving engagement between the sliding carriage 150 and the bolt assembly 56 during ramming or forward movement of the bolt as will be described.

A central portion annular end plate 166 of the carriage 150 also acts against a flat longitudinal section bolt extraction spring 174 which is disposed concentrically about the rear bolt extension 90 and the carriage guide tube 151 and engages at its rear end an annular weight 176, which in turn engages an annular high energy Belleville spring 178, abutting a threaded end plate 180 secured to the end of the bolt rear extension portion 90. This is accomplished by means of a threaded stem 182 being threadably engaged with a threaded portion of the interior bore 88. The end plate 180 acts as a reaction point allowing compression of the bolt extraction spring 174 upon rearward movement of the carriage 150 by the power cylinders 122 and 124. The compression of bolt extraction spring 174 is designed to proceed to its fully collapsed condition. This allows it to act as a solid member, transmitting the force applied from the carriage 150 into the high energy Belleville or washing spring 178, by the annular weight 176 forcing the same against the end plate 180. The end plate 180 of course during this portion of the cycle is held stationary by virtue of the bolt assembly 56 being locked as will be described hereinafter.

The carriage return springs 152 and 154, on the other hand, are abutted against an abutment plate 184 (FIG. 13) positioned at the rear end of the housing 12 which also serves to absorb the reaction to prevent the pressure of the carriage return springs 152 and 154 from being exerted on the sliding plate sear mechanism 92.

Thus, the bolt extraction spring 174 is designed so that it may be collapsed to its fully compressed length at force levels below those developed by the gas pressure for the purpose of transmitting the pressure exerted by the carriage 150 unto the Belleville spring 178, which stores this energy for the purpose of momentarily reducing or eliminating the load exerted on the end plate 180 by compression of the bolt extraction spring 174.

Positioned along one side of the receiver frame 44, i.e., the left side as viewed in FIGS. 6 through 13, against the flat surface 108 is a feed leaf spring 186 (FIGS. 17) which is adapted to provide the force required for advance of the ammunition through the breech openings as will hereinafter be described, but also serves in the sequencing of movements during bolt actuation by means of a carriage catch tab 188 (FIG. 4) which protrudes into a slot opening formed in the side of the receiver frame 44. The carriage catch tab 188 is positioned so as to allow the carriage 150 to pass by in rearward movement and then to abut the face of the central plate portion 166 to prevent forward movement upon release of the bolt assembly 56. The carriage catch tab 188 also functions to restrain the movement of the feed leaf spring 186 outwardly whenever the carriage 150 is in forceful engagement therewith due to the frictional forces developed therebetween.

The outward force of the feed leaf spring 186 (FIG. 17) is created by a slide plate 190 (FIG. 18) which passes between a forked end section 192 of the leaf spring feed member 186, which has a pair of curved fingers 194 and 196 which are compressed against the surfaces 108 of the receiver frame 44 by the slide plate 190 as the end plate 180 moves to the rear after release of the bolt assembly 56 by the locking mechanism, as will be described in reference to the ammunition feed mechanism. The slide plate 190 is balanced by a slide guide 191 on the opposite side of the end plate 180 preventing tipping of the end plate 180.

The energy stored in the highly compressed Belleville spring 178 is utilized to unload the end plate 180 from the pressure of the fully compressed bolt extraction spring 174 after the pressure has dropped in the barrel bore 94, this occurring after the bullet has passed out of the bore 94. The reduction in pressure results in a substantially reduced rearward force exerted by the piston assembly 122 and 124 on the carriage 150 which allows the Belleville spring 178 to relax while momentarily reduces the load on the end plate 180. The duration of this reduction in load is extended by the inertia of the annular weight 176 which is accelerated by the force of the compressed Belleville spring 178.

It should be noted that a clearance would be allowed between the carriage catch tab 188 and the carriage 150 upon full compression of the bolt extraction spring 174, so as to accommodate a slight forward movement of the carriage 150 upon the gas pressure being vented, the carriage 150 then moving into engagement with the carriage catch tab 188. This accommodates the movement of the Belleville spring 178 and the annular weight 176 as the Belleville spring 178 relaxes. The annular weight 176 may be formed of high density metal such as a lead alloy to increase its inertia for this purpose.

As noted, the carriage 150 moves slightly forward to engage the carriage catch tab 188 and at the same moment, the reduction in rearward pressure allows bolt unlocking to release the bolt assembly 56 as will be described hereinafter.

This release of the bolt assembly 56 allows the compressed bolt extraction spring 174 to force the end plate 180 and the attached bolt rear extension 90 and forward bolt section 172 to the rear, with the carriage catch tab 188 providing a reaction point such that the carriage 150 is rendered stationary against forward movement to force the bolt assembly 56 to move rearwardly and extract the expended cartridge casing from the chamber 50.

During this movement, the frictional interengagement between the carriage 150 and the carriage catch tab 188 prevents the feed leaf spring 186 from moving outwardly by virtue of the compression of the curved finger sections 194 and 196 by the slider plate 190, until the bolt assembly 56 moves sufficiently to the rear that the shoulder section between the forward bolt section 172 and the rear extension 90 contacts the front face of the central annular plate 166 of the carriage 150. The length of travel of the bolt 56 is such that after rearward travel of the bolt assembly 56, the carriage is lifted from engagement with the carriage catch tab 188, which interrupts the frictional connection therebetween and allows the feed leaf spring 186 to move outwardly, releasing the carriage 150 and allowing it to again move forward under the influence of the carriage return springs 152 and 154.

This occurs after an inertia induced hesitation sufficient to allow the movement of the feed trays 66 and 68 through the breed opening takes place, as will be described in detail in reference to the feed mechanism.

The forward movement of the carriage 150 also causes the ramming movement of the bolt assembly 56 forward by virtue of the shoulder engagement therewith and at the same time the ammunition leaf spring 186 is again forced against the receiver surfaces 106 and 108 by engagement with the slider plate 190. The central annular plate 166 of the carriage member 150 moves into abutment with the end surface of the receiver frame 44 as shown in FIG. 3.

The hammer 76 is restrained during forward movement of the bolt assembly by virtue of a stem 198 integral with the hammer head 74 and a sear catch 200, restraining the hammer 76 by engagement with the sear plates 92, as will be described hereinafter. Bolt assembly 56 (and end plate 180) moving forward thus causes compression of the hammer spring 202 during the ramming movement of the bolt assembly 56.

The feed mechanism has in the meantime, prior to the ramming or forward movement of the bolt 56, positioned a fresh round in the breech in alignment with the bolt assembly 56 received within grooves 60 (FIG. 7) as will be described.

BOLT LOCKING AND UNLOCKING

As was described in the above-referenced patents to the present inventor, the functioning of the weapon according to this application and those patents does not involve rotation of the bolt and sections thereof to perform the bolt locking function. The bolt locking of course, being that function which restrains the bolt from rearward movement during the actual firing of the round, resisting the heavy force tending to drive the bolt to the rear. Rather, the approach described in those patents is to use a nonrotating bolt and a separate locking element which cooperates with recesses on the length of the forward bolt section 172 (FIG. 9) to provide the locking of the bolt assembly 56.

Accordingly, a bolt latch element 204 is provided which is received within a recess 206 (FIG. 9) in the receiver frame 44 cooperating with a recess 208 formed around the main bolt portion 172. The bolt latch element 204 has a central opening (FIGS. 18 through 22) which is shaped to be complementary to the cross-sectional configuration of the forward bolt portion 172 such that when the bolt latch 204 is oscillated to the position with the central opening in alignment therewith, the bolt assembly 56 may be released for its rearward extraction movement as described. However, when the bolt latch element 204 is oscillated to a position in which the central opening is out of alignment with the bolt forward sections 172 as shown in FIGS. 7 through 9, the bolt is locked against movement and it can be seen that the rearward forces are resisted by pressure exerted on the front and rear faces of the bolt latch element 204 disposed within the receiver recess 206 and the bolt recess 208.

It is the frictional forces existing between the forward surface of the bolt recess 208 and the rearward surface of receiver recess 206 which are greatly reduced by the arrangement described above in connection with the Belleville spring 178 and the annular weight 176.

The bolt latch element 204 is operated by means of a tail section 210 which is engaged by a bolt latching leaf spring 212 mounted exteriorly of the housing 12 and secured to the rear sight bracket 30 and lying along side the receiver frame 44 as shown in FIG. 9. The bolt latch return spring 212 is biased to the position shown in FIG. 9 such that it urges the bolt latch 204 into a locking position as shown in FIG. 9 with the flat 214 of the actuating tail section 210 lying along the interior edge of the return spring 212 in the latching position shown in that FIGURE. The tail section 210 is adapted to be received within an arcuate recess 216 formed under receiver frame 44 as shown in FIG. 9. The interior surfaces opposite the flat 214, 220 abut a flat formed on the receiver frame 44 so as to locate the bolt latch element 204 in final latching position as shown in FIG. 9.

The bolt latch element 204 is unlatched by engagement with a cam plate 224 (FIG. 18) having a curved configuration in conformance with the arcuate top and bottom radii of the receiver frame 44.

The cam plate 224 has a pair of cam surfaces 226 and 228 formed thereon, cam surface 226 being adapted to engage the end face 230 of the bolt latch element 204 on the extreme end of the arcuate tail section 210. The cam surface 228 would engage this surface upon reversal of the cam plate 224 in the assembly for purposes of left hand operation.

The engagement of the cam plate 224 causes the oscillating movement of the bolt latch element 204 against the bias of the return leaf spring 212 when the cam plate 224 is moved rearwardly.

This rearward movement is brought about in two basically different ways depending upon the mode in which the mechanism is being actuated. In the automatic or semiautomatic cycling of the bolt actuation, the cam plate 224 is drawn to the rear by a spring connection with carriage 150, whereas in the manual actuation mode a driving connection is created between the manual actuation slider 22 and the cam plate 224, so as to allow a different sequencing of operation. In the gas pressure operated cycling of the weapon, the unlatching of the bolt assembly 56 necessarily awaits the movement of the carriage 150 to the rear whereas in manual actuation the bolt must be first released to allow subsequent movement of the parts by simple stroking of the manual actuation slider 22. In addition, the proper sequencing of the parts is produced by the gas pressure preventing operation of the bolt latch element 204 until the bolt assembly 56 is to be released. Accordingly, there is a different movement of parts which takes place causing the cam plate 224 to be drawn to the rear in these two basically different modes of operation of the bolt unlocking mechanism.

In the semi-automatic and automatic modes, the carriage 150 is adapted to move a camming fork 218 (FIG. 18) having a face plate 232 which is received within the lower slot 168 of the carriage 150 so as to be moved rearwardly with movement of the carriage 150 to the rear. The rear surface of the face plate 232 engages a spring block 84. The rearward movement of the camming fork 218 is between a pair of cam rails 235 and 236 with the tines 238 and 240 being positioned inside the lateral interior edges of the rear section 242 and 244 of the respective cam rails 234 and 236.

Wound about the tines 238 and 240 and the rear sections 242 and 244 are respective compression springs 246 and 248 (FIGS. 10 and 11). This rearward movement compresses the springs 246 and 248 against the protrusions 254 and 256 on the rear sections 242 and 244 of the cam rail 234 and 236, respectively, creating an urging force on each of the cam rails 234 and 236 which tend to urge these rails to the rear.

The cam plate 224 is carried on forward sections 258 and 260 joined to the cam rails 234 and 236 by offset shoulders 262 and 264.

The cam plate 224 has post recesses 266 and 268 which seat on post sections 270 and 272 formed on the forward sections 258 and 260 of the cam rails 234 and 236 by virtue of this connection and creating an urging force tending to move the cam plate 224 to the rear whenever the unlatching of the bolt latch 224 is prevented by virtue of the pressure exerted on the bolt latch element 204 during firing and while the bullet is still within the bore 94. Upon release of this pressure, the compression springs 246 and 248 are allowed to extend, driving the cam rails 234 and 236 to the rear and carrying the cam plate 224 with it, which by engagement with end face 230 of the bolt latch element 204 unlocks the bolt assembly 56 and allows its rearward or extracting movement as described above.

Spring block 84 compresses by its rearward movement a pair of cam closing springs 274 and 276 (FIG. 11) piloted on rods 278 and 280 as shown in FIG. 18. The cam closing springs 274 and 276 are seated against the butt plate 184 with the pilot rods 278 and 280 secured in bores 282 and 284 of the spring block 84 (FIG. 18) and in bores 286 and 288 of the butt plate 184 (FIG. 13). The outer lugs 283 and 285 of the spring block 84 come into abutment with the shoulders 294 and 296 created by the offset sections 262 and 264 of the cam rails 234 and 236. Thus, the springs 274 and 276 being compressed create a return force on the cam rails 234 and 236.

After the bolt assembly 56 returns to the forward position, the compressed springs 274 and 276 acting on the spring block 84 drive the camming rails 234 and 236 to the forward position carrying the cam plate 224 therewith and allowing the return leaf spring 212 to again position the bolt latch element 204 in the latched position.

The manual actuation slider 22 is formed with a pair of integral rails 298 and 300 which are adapted to be disposed between the interior lateral faces of the forks 238 and 240 of the camming fork 218. The rear surfaces of the rails 298 and 300 are in abutment with the front face 302 of a manual operation tray 304. The manual operation tray 304 is likewise slidably disposed between the interior surfaces of the fork tines 238 and 240 allowing a clearance for the springs 246 and 248. The manual operation tray 304 is also formed with a trigger fork opening 306 which is adapted to receive the trigger fork 308 which will be described in operation in conjunction with the Trigger/Selector.

The manual operation tray 304 is formed with a pair of slide rails 310 and 312 which upon movement of the manual actuation tray 304 to the rear engage the stops 314 and 316 formed on the lower edge of the rear portion of the cam rails 242 and 244 and subsequently the protrusions 250 and 252 formed on the tines 238 and 240 of the camming fork 218.

Upon rearward movement of the manual actuator 22, the slide rails 298 and 300 force the manual actuation tray 302 to the rear which in turn carries the cam rails 234 and 236 to the rear which unlatch the bolt assembly 56 by movement of the cam plate 224 past the end face 230 and then subsequently engages camming fork 218 moving the bolt assembly 56 to the rear by movement of the carriage 150 acting on the bolt extraction spring 174.

The bolt assembly 56 is adapted to remain in the open position upon retraction to the rear to clear the breech opening by means of a rocker catch 324 which is pivoted by means of a cross support 326 within the rear cover 38. The rocker catch 324 has a rearward portion 328 which is adapted to be rocked up into engagement with the frontal face of the face plate 232 of the camming fork 218 so as to latch the same in the retracted position. The rocker catch 324 can be activated by means of operation of the manual actuation slider 22.

Figure 19:
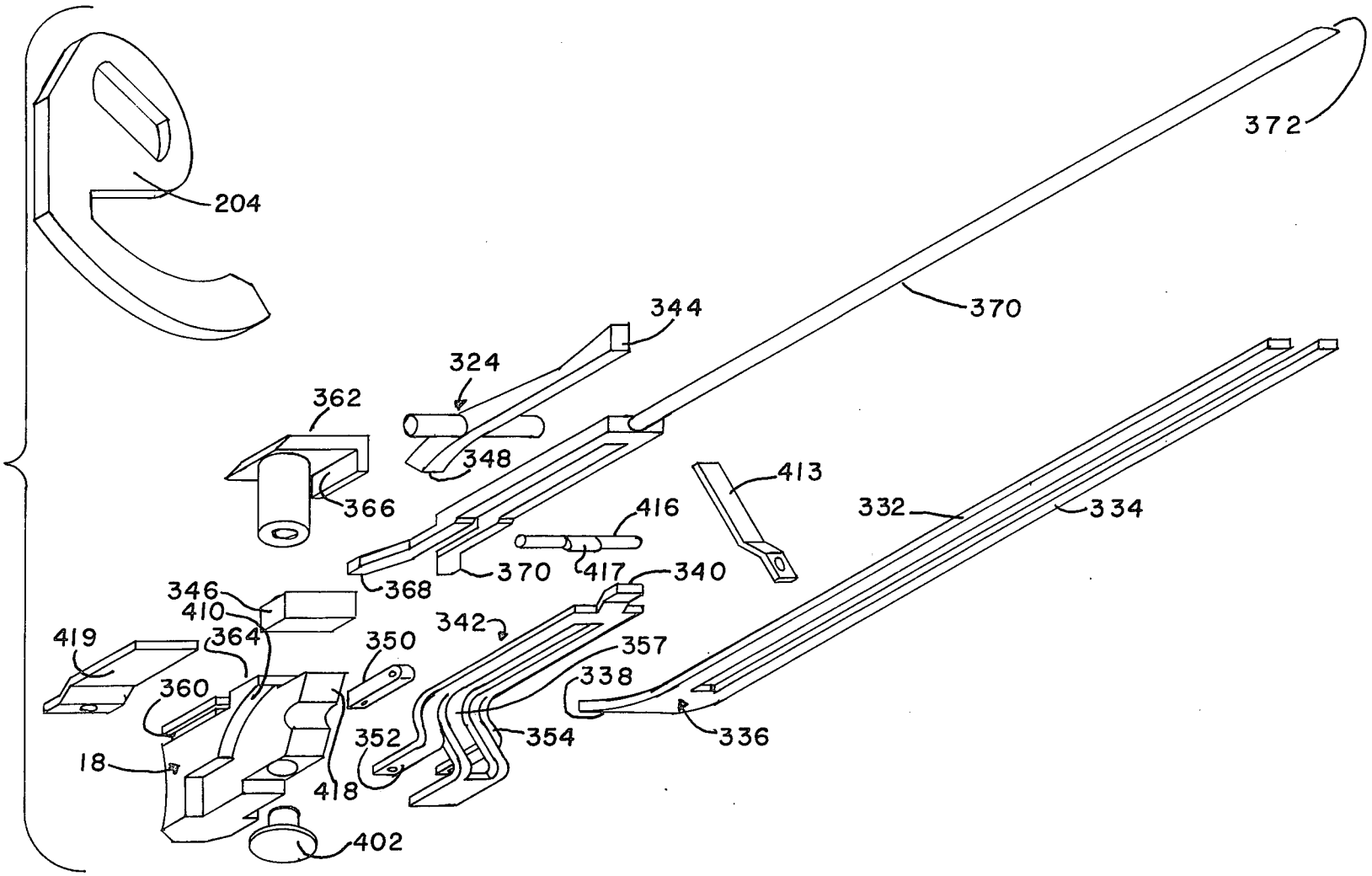
FIG. 19 is an exploded perspective view of various components associated with the trigger selector mechanism incorporated in the automatic weapon according to the present invention.

The manual actuation slider 22 has a pair of side rails 298 and 300 into which are formed recesses 328 and 330, which receive opposite sides of a pair of tines 332 and 334 of a leaf spring 336 (FIG. 19). Sliding movement of the manual actuation slider 22 allows the end 338 of the leaf spring 336 to curl upwardly and into engagement with a tab 340 formed on a selector spring 342. Tab 340 engages the underside 344 of the rocker catch 324 so as to ride up in front of the cam fork 218 as described.

The disengagement of the rocker catch 324 and bolt assembly 56 is caused by the trigger mechanism in which a block member 346 (FIG. 19) engages an inclined front face 348 of the rocker catch 324 forcing it to rotate about pivotal support 326 and out of engagement with the cam fork 218 to thereby release the same.

In the automatic mode, the selector spring 342 is urged upwardly by means of the movement of the selector lever 34 which is engaged with a pair of selector links 350, one of which is shown in FIG. 19 which in turn is connected to a pair of tabs 352 and 354 on a selector spring 342 so as to produce the upward bias of the tab 340 when the selector lever 34 is in its fully rotated position as will be described hereinafter.

THE TRIGGER/SELECTOR MECHANISM

The trigger/selector mechanism components are shown in FIGS. 19 through 22, and include the trigger 18 which is slidably disposed in the housing 12 by receiving the lower edges of the cover 38 which form a slot in which is received the recessed upper portion 360 of trigger 18 so as to provide a slidable mount for the trigger 18.

Trigger 18 is adapted to engage the trigger fork 308 by means of a trigger plate 362 in the semi-automatic mode. The trigger plate 362 is seated on the upper portion 364 of the trigger 18 (FIG. 19) with a lateral surface 366 extending along the edge of the upper surface 364 so that as the trigger is pulled, the trigger plate 362 moves to the rear and engages one or the other of prongs 368 and 370 of the trigger fork 308 depending on whether the weapon is assembled for right or left hand operation.

The trigger fork 308 has a stem portion 370 with a chamfered end surface 372 which acts to engage with a sloping surface 373 of sear plate 374 (FIG. 3).

The sliding plate sear mechanism 92 is of the type described in the above-mentioned patents and includes a pair of leaf bias springs, an upper bias spring 378 (FIG. 3) and a lower bias spring 332 and 334 (FIG. 19) comprised of the end sections of a leaf spring 336. The front sear plate 374 and rear sear plate 376 are both mounted by means of a pair of slidable tabs 382 and 384, and 386 and 388, respectively, (FIGS. 14 and 15).

The front sear plate 374 has a central opening 390 with an upper flat 392 (FIGS. 14 and 15), while the rear sear plate opening 394 has a lower flat 396. The tab 382 is engaged with the upper leaf spring 378 as is the upper tab 386 of the rear sear plate 376. The upper leaf spring 378 dominates the lower bias springs 332 and 334 such that both sear plates 374 and 376 will be urged to the downward position by the upper sear springs 378 when the trigger fork stem 370 is not forcefully engaging the lower tab 384. When the hammer catch 200 is moved to the rear by movement of the bolt assembly 56 to the rear during the extraction movement, the sear catch 200 is moved to the position shown in FIG. 3 and the chamfered surfaces 398 cooperating with similar surfaces on the flats 392 and 396 of the sear plates 374 and 376 to push the same out of the way.

When both sear plates 374 and 376 are retained in the initial depressed condition by virtue of the dominant influence of the spring 378, the sear catch 200 catches on the upper flat 392 of the frontal sear plate 374 moving past the rear sear plate 376 which has been depressed by the dominant spring 378. Upon movement of the trigger fork 308 to the rear, the frontal surface 373 of the sear 374 influenced by the terminal portion of the stem 370 forces front sear plate 374 upwardly to displace the flat 392 and release the sear catch 200 allowing the hammer spring 202 to drive the hammer head 74 forward and fire the weapon by impact with the rear portion of the firing pin 82.

The semi-automatic mode of the firing cycle, of course, would take place sufficiently rapidly that the firer would still have his finger on the trigger 18 and hold it in the depressed condition and the rear sear plate 276 acts to catch the sear catch 200 in this event since the surface 372 engaging surface 373 has forced the front sear plate 374 upwardly removing the influence of the upper leaf spring 378 on the rear sear plate 376. The front sear plate 374 is formed with a lower tab 375 including a cross piece 377 which is positioned between the leaf spring portions and acting to urge the leaf spring portions 332 and 334 upwardly. This causes lower leaf spring portions 332 and 334 to act on the rear sear plate 376 and force it upwardly into catching position so that the lower flat 396 will now retain the sear catch 200 until the trigger 18 is released. Release of the trigger 18 allows the upper leaf spring 378 to again dominate and the sear catch 200 to slip forward to be caught by the front sear plate 374 then to be released by another depression of the trigger 18.

The selector lever 34 controls the rotation position of the pair of selector links 350 by being connected to a common selector lever pin 416 (FIG. 3) with clearance 414 formed in the trigger 18 to accommodate pin 416 when trigger 18 is depressed.

In the fully automatic mode, the selector lever 34 is rotated so as to cause the links 350 to move the selector spring 342 upwardly with the lower step portion 400 engaging the lower stem 402 of a trigger plate pedestal 404. A compression spring 406 (FIG. 3) is provided which biases the trigger plate 362 downwardly in the semi-automatic mode so that the lateral surface 366 remains in engagement with the trigger 18 as described, but rotation of the selector links 350 downward, the step tab 400 overcomes the bias of the compression spring 406 (FIG. 3), forcing the pedestal upwardly and allowing it to become pivotable with respect to the trigger 18.

The trigger plate 362 in this mode is adapted to be oscillated by means of a lower arcuate surface of the bolt latching element 204.

The trigger fork 308 is biased forwardly by means of the manual actuation return spring 412 which acting on the interior of the manual actuation tray 304 and the opening 306 acting on the shoulders of the trigger fork 308, acts to urge the trigger fork 308 forward. By engagement of either end prong 368 or 370, this bias acts to urge the pedestal 404 to be rotated so that the trigger plate 362 is rotated into the path of the end face 230 of the tail section 210 of the bolt latching element 204.

Figures 20, 21, 22:
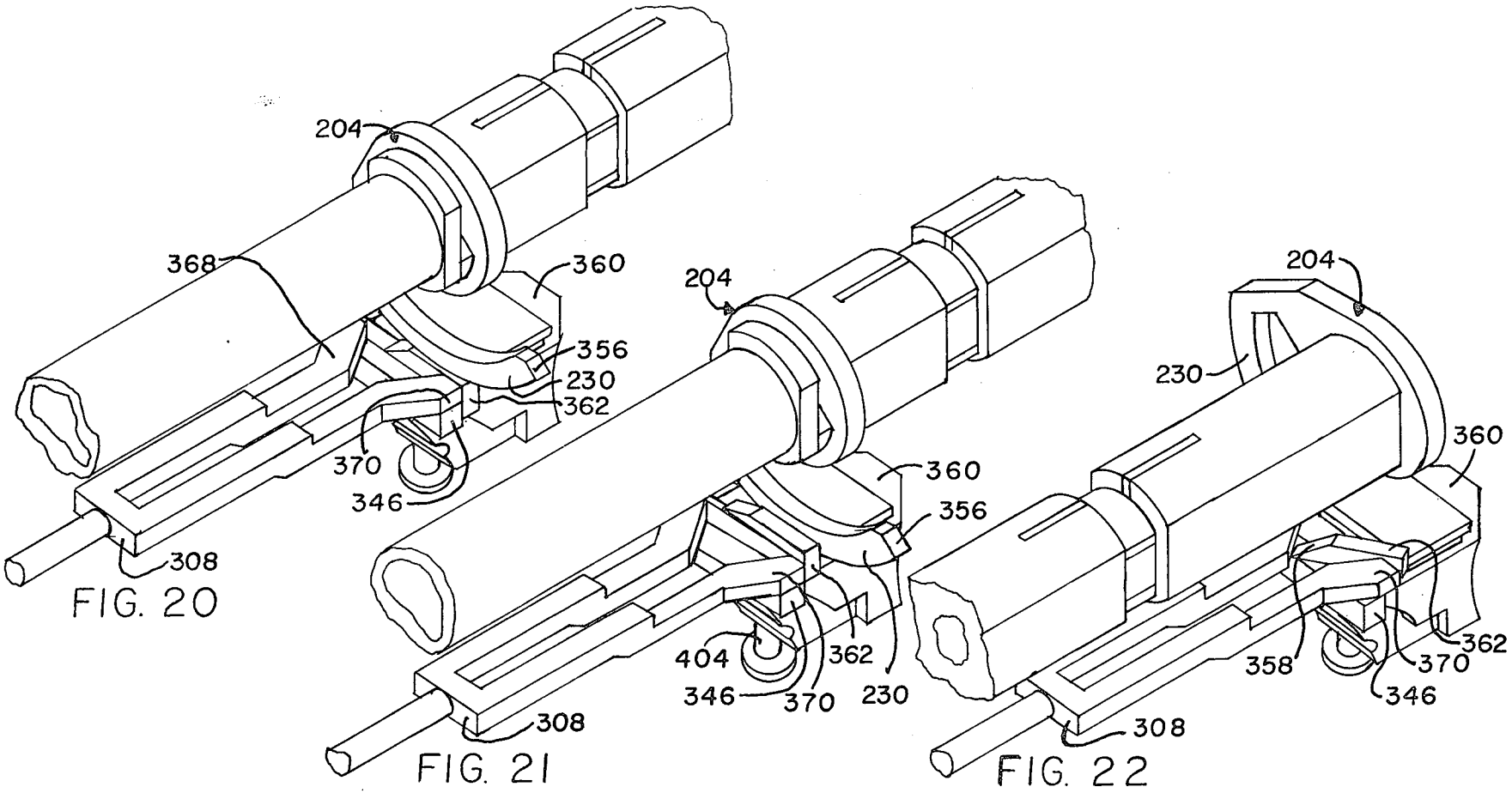
FIGS. 20 through 22 are perspective views of the bolt latching element and the trigger mechanism components operated by the bolt latch, showing in each of the views different relative positions of the bolt latching element and the relative trigger mechanism components occurring during operation of the trigger.

Thus, each time the bolt latching element 204 is moved by the cam plate 224 to the unlatched position, the trigger fork 308 rotates the pedestal trigger plate 362 forward as shown in FIG. 22. Upon movement of the bolt latching element 204 to the latched position, the trigger plate 362 is rotated about its pedestal 404 forcing the trigger fork 308 rearward to the position shown in FIG. 21, to thus fire the weapon automatically when the selector lever 34 is in the automatic position.

Cessation of automatic fire upon release of the trigger 18 is accomplished by engagement of a level surface 356 formed on the end face 230 of the bolt latching element 204 moving into engagement with a ramp surface 358 formed on the side of the trigger plate 362, which has moved into the path of the end face 230 by release of the trigger 18. This cams the trigger plate 362 and pedestal 404 down to the position shown in FIG. 20 to discontinue firing.

An interlock arrangement is provided by interference between the bolt latch tail 210 and the pedestal plate 362 when the automatic mode select is first initiated as shown in FIG. 20. Thus, the pedestal 404 will not be allowed to move upwardly out of engagement with the trigger surface 364 by rotation of the selector lever 34 until the trigger 18 has been depressed to initiate the automatic firing cycle. Depression of the trigger 18 moves the trigger plate 362 rearwardly out of alignment with the bolt latching element tail 210 allowing the pedestal 404 and trigger plate 362 to be moved upwardly to the position shown in FIG. 21. The weapon then may cycle in the normal fashion in the automatic mode. Thus, the automatic mode of operation must be selected before the trigger is depressed.

The trigger return spring 413 (FIG. 19) is disposed behind the trigger 418 and anchored to the lower cover at the top rear of the hand grip, in line with the open slot 357 of selector spring 342.

The selector lever 34 is also used as a safety with the leading edge of the links 350 (FIG. 19) moved in the safety position to cooperate with a curved recess 410 formed on the trigger 18 to prevent the trigger 18 from being depressed so as to act as a weapon safety.

Upon movement of the selector lever 34 in the counterclockwise direction as viewed in FIG. 3, the tab portion 340 of the element 342 is urged upwardly. Accordingly if the weapon is being fired in the automatic mode, and the selector lever 34 is manipulated to this position, and the trigger 18 is released, block 346 is released from full force engagement with surface 348. The latching tab 340 thus urges rocker catch 324 into latching engagement with the frontal surface of the camming fork 218 so that the bolt assembly 56 will remain in the full open position, thus providing means for automatically causing the bolt to be latched in its rearmost position upon cessation of fire.

In this mode, it is necessary to insure that the trigger 18 does not move forwardly to the return position as the bolt assembly 56 is moving forwardly since this could result in the bolt assembly 56 remaining in the closed position upon cessation of fire. This is generally undesirable since the last seated ammunition round 54 could be caused to "cook off" or seize in the chamber 50, if sustained fire has occurred.

Accordingly, the selector pin 416 is formed with a cam surface 417 which rotates into engagement with the trigger return spring 413 to disable it when the selector lever 34 is in the fully automatic mode position.

A trigger drag spring 419 (FIGS. 3 and 19) imposes a frictional drag force on the trigger 18 to insure that the trigger 18 does not drift into the return position.

Should the operator then desire to close the bolt without firing the weapon, the lever 34 is then rotated clockwise past the safety position. This rotates the pivotal link into contact with block 346 sliding it rearward until it strikes the forward edge of the rocker catch 324 rotating it to disengage from the front face 232 of camming fork 218.

AMMUNITION FEED AND EJECTION

The ammunition feed system includes a pair of feed trays 66 and 68 (FIG. 16) which were previously mentioned, and also the feed leaf spring 186 (FIG. 17). The feed leaf spring 186 has a pair of forward fingers 420 and 422 which pass into respective openings 424 and 426 of the upper and lower feed trays 66 and 68, respectively, such that the feed trays are caused to move with the movement of the ammunition feed leaf spring 186. Thus, upon outward movement, as indicated in phantom in FIG. 4, the feed trays 66 and 68 are moved outwardly as also indicated in phantom and upon movement of the bolt forward, the leaf spring 186 is caused to move back into lateral abutment with the receiver frame. This causes the feed leaf spring 186 to move the trays 66 and 68 back to the return position shown in FIGS. 6 through 8.

The feeding movement of the feed trays 66 and 68 takes place during the hesitation of the bolt at its extreme rearmost position, inertia of the parts allowing a sufficient interval of time with the bolt in the full rear position to allow the rapid advance of the movement of the feed leaf spring 186 causing the spent casing to be stripped from the bolt face 62 by the movement of the link belt and advancement of a fresh round into the grooves 60 in the bolt face 62. The forward movement of the bolt assembly 56 secures the link belt in position so that upon lateral movement of the feed leaf spring 186 back into abutment with the receiver frame, the belt remains stationary while the feed trays ride over the link and engage the trailing edge 452 of the next link in preparation for another feed cycle.

Before describing the engagement of the feed trays 66 and 68 with the link belt, the links 432 and the belt assembly will first be described.

Figure 23:
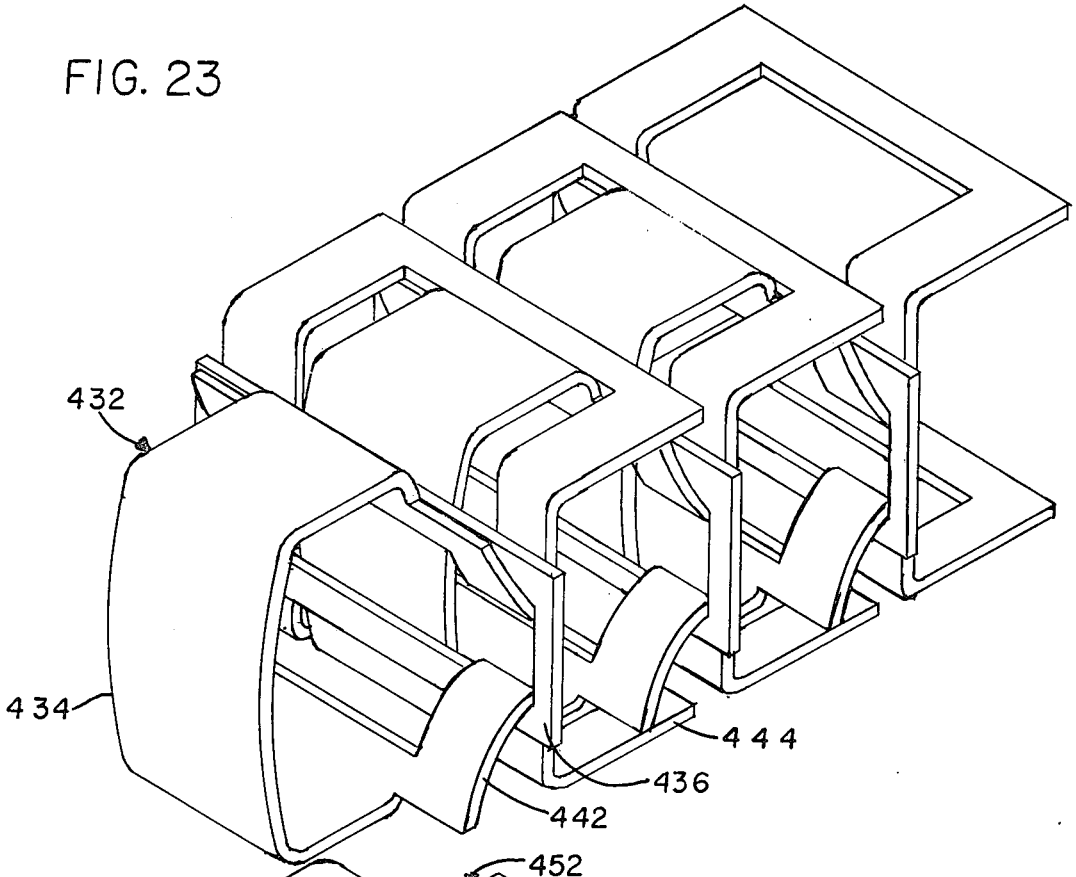
FIGS. 23 and 24 are views from differing perspectives of an assembly of several of the links in the ammunition belt which is adapted to cooperate with the feeding mechanism incorporated in the automatic weapons according to the present invention to feed belt mounted ammunition automatically into the weapon and to receiver extracted cartridge casing and carry them out of the receiver breech openings.
Figure 24:
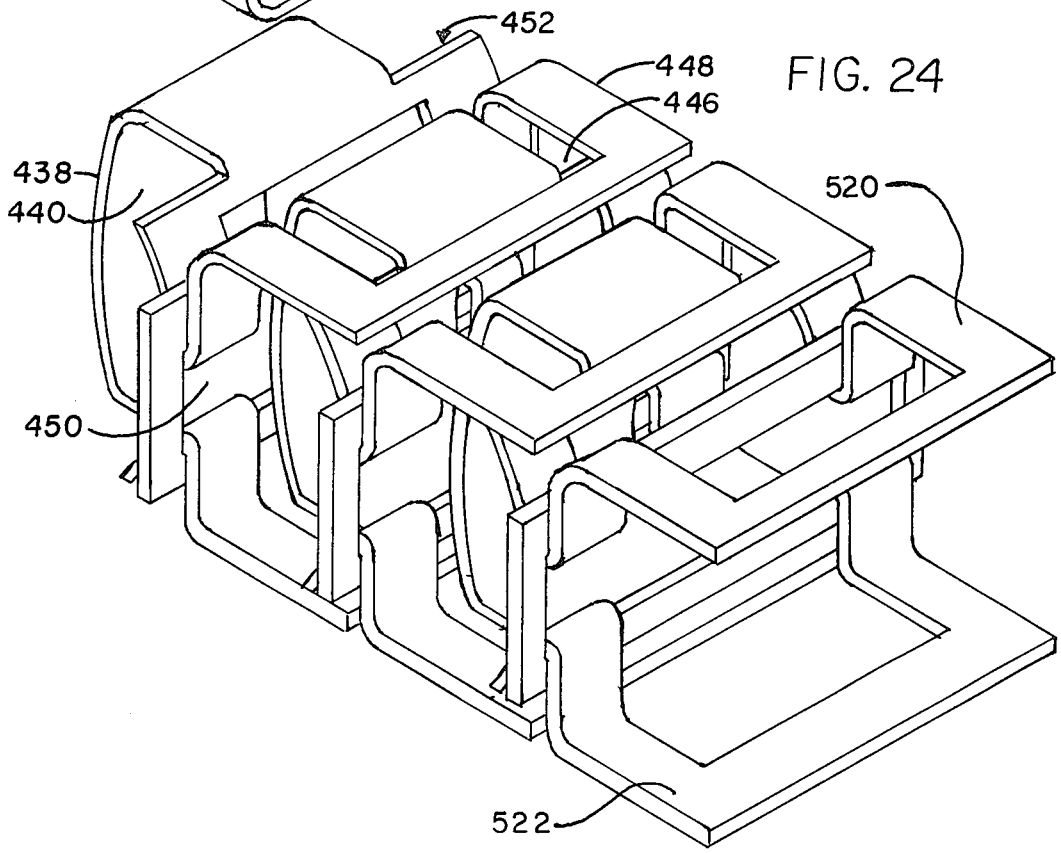

FIGS. 23 and 24 illustrate in two different perspectives an assemblage of links 432 forming a belt for feeding ammunition to the feed mechanism. Each link 432 includes a loop element 434 and a cinching element 436. The loop element 434 is formed of spring steel stamping or other suitable construction comprising a forward loop section 438 having an opening 400 of appropriate configuration for the type of ammunition to be used. Also, each loop element 434 has a pair of leg sections extending from the loop section 438 from closely spaced points having outwardly diverging portions 442 and 444, respectively. The leg sections 448 terminate in forwardly bent sections forming shoulders 452 of greater width than the forward loop sections 438 and formed with an opening at 446 so as to receive therein the upper portion and lower portion, respectively, of the loop section 438 of the succeeding link. The leg sections 448 are retained together by means of the cinching element 436 having an appropriately sized opening 450 so as to correctly position leg sections 448 apart so that a frictional engagement may be obtained upon snapping the leg sections 448 over the forward loop sections 438 as shown in FIGS. 23 and 24.

To assemble each link, each individual link is joined with a cinch element 436 passed over the leg portions 448. This may require the forming of the leg sections 448 after the cinch element 436 has been placed in position or the cinch element 436 may be formed with a releasable seam so as to enable this assembly to be carried out.

It can be seen that the link belt assembly shown in FIGS. 23 and 24 with the limited relative rotation accommodated by the shoulders 452 and engagement with the successive link maintains the belt assemblage in a more or less horizontal mode such that as the belt is fed into the breech opening 40, excessive downward curvature such as to create a misfeeding of the link belt due to the tabs 502 and 504 not properly engaging the leg section 448 is precluded.

As noted, the lateral movement of the feed leaf spring 186 and of the upper and lower feed trays 66 and 68 causes the ammunition belt to be advanced into the receiver frame breech opening 40.

Each of the feed trays 66 and 68 is formed with an inwardly facing recess 480 and 482, (FIG. 16) respectively. These recesses are formed by a two-piece construction of each of the feed trays 66 and 68 such as to facilitate the manufacture of feed trays provided with recesses 480 and 482, since by making the feed trays 66 and 68 of a two-piece construction, simple stampings may be utilized rather than more costly machined parts.

The two-piece construction includes outer members 486 and 488 and inner members 490 and 492. These members are nested together by appropriately configured end sections as shown to insure that the forward tines 420 and 422 cause both inner and outer members of the feed trays 66 and 68 to be moved together.

The outer members 486 and 488 each have overlying plate portions 494 and 496 which overlie the recessed cut-out portions 480 and 482 formed into the inner members 490 and 492, respectively. The overlying plate portions 494 and 496 are each formed with clearance cut-outs 498 and 500 for a purpose to be described hereinafter.

A pair of oppositely extending tabs 502 and 504 are also provided on each of the overlying plate portions 494 and 496 which serve to exert an inward resilient biasing pressure on feed trays 66 and 68 by contact with the receiver opening to insure adequate grasping pressure of the feed trays 66 and 68 in engaging the links 432 in the link belt assembly.

The engagement of the feed trays 66 and 68 is by nesting of the leg portions 448 in each link 432 on either side of each link 432 into respective recesses 480 and 482. The pressure exerted by the tabs 502 and 504 insures the recesses to properly engage the legs 448.

The outer portions of the overlying plate 496 and 494 and the recessed plates 480 and 482 are chamfered as seen in FIGS. 25 and 26 to allow the feed trays 66 and 68 to ride up over the loop portion 434 of each link 432 which remains stationary in the breech opening 40 when the belt assembly 56 is in the advanced position as shown in FIG. 25, and during the inward movement of these feed trays 186, such as to move out of engagement with the link previously centered within the breech opening 40 and which has been separated from the link belt as will be described.

In the position shown in FIG. 26, the movement of the feed spring 186 to the right has taken place and leg section 448 of link 432 has been received within recesses 480 and 482.

As can be appreciated from the description above, the links 432 in the link belt assembly are assembled together without the shell casing 50 holding the assemblage of the respective links 432 together as in conventional automatic weapon ammunition belts. Thus, unless the links 432 are separated after being advanced through the weapon receiver, the belt containing shell casings would grow in length and perhaps present difficulties in handling of the weapon if a considerable length of belt accumulates.

Accordingly, means are provided for separating the links from the belt after the respective link has positioned its round in position within the weapon receiver opening 40. This arrangement includes a pair of spreader wings 506 and 508 as shown in FIGS. 26, 3 and 8, each received within longitudinally extending slots 510 formed within the bolt main portion 172 as seen in FIG. 26. Each spreader wing 506 and 508 is formed with a central wedge 512 and 514 which is adapted to mate with a mating wedge-shaped recess 516 and 518 formed on either the upper or lower surface of the firing pin 72 when in the cocked position. The shape of the wings 506 and 508 is produced by opposite separated end portions 520 and 522, respectively, which serve to straddle the link loop sections 432 when the link 432 is positioned in surrounding relationship with the bolt main portion 172.

The separation occurs upon firing which causes the wedges 512 and 514 to be forced out of the corresponding recesses 516 and 518 formed in the firing pin 72. The end portions 520 and 522 straddle the link loop portion 434 and come into engagement with the inside surface of the link leg 448 of the preceding link 432 which has previously been advanced out of a recess opening 40 and remains engaged with the previous link by being frictionally overlying on the loop portion 434 of the link 434 remaining centered on the bolt main portion 172.

The movement of the wing separators 506 and 508 is against the bias of the spring clip 526 which encircles the main bolt portion 172 and is disposed within a recess 528 formed about the central region of the longitudinal slot 510 to be accommodated by the opening in the bolt latch 204. The spring clip thus insures return movement of the wing portion 506 and 508 back into engagement with the firing pin after the firing pin has returned to its cocked position.

Thus, upon spreading of the legs 448 by the outward movement of the end portions 520 and 522, a separation force is generated by the compression together of the legs 448 and reflected in a force component acting to cause the link to move away and outwardly of the extending wing end portions 520 and 522 causing the links to be completely separated from the remainder of the belt assembly. This occurs at the moment of firing.

The overlying plate portions 494 and 496 are formed with recesses 495 and 497, respectively, which accommodate the outward movement of the portion 448 of the link so separated.

As shown in FIG. 8, the end portions of the feed trays 66 and 68 are protected by a pair of blocks 524 and 526 which serve to prevent damage to the relatively fragile feed tray ends 66 and 68 as they are projecting from the receiver openings during the feed movement capturing the next link leg 448.

To recapitulate this feed sequence, assume in FIG. 26 that the bolt was retracted sufficiently to cause the feed spring 186 to move away from the receiver and move the feed trays 66 and 68 to the left or away as viewed in this FIGURE, causing the link 432 to be moved out of alignment with the bolt main portion 172. In FIG. 25, the succeeding link is not shown in order that the details can be seen of the engagement of the link 432 being advanced out of the receiver.

However, in the position shown in FIG. 25, there would be a successive link with its loop section 434 drawn into alignment with the bolt main portion 172 in this position by engagement of the feed tray recesses 482 and 484 pulling the link 432 with movement of the feed trays 66 and 68. Thus, upon advancing movement of the bolt main portion 172 during the return of the bolt assembly, the bolt main portion 172 passes through this loop section 434 such as to anchor the same in position within the receiver opening 40.

Accordingly, upon the feed spring 186 being again returned against the receiver housing, the feed trays 66 and 68 may then move relative to the link which it had previously been engaged with. The leading chamfered surfaces guide the motion of the feed trays 66 and 68 over the next leg portion 448 of the link in position with its loop section 434 centered on the bolt main portion 172 to thus secure engagement of the feed trays 66 and 68 preparatory to the next feeding motion.

When the round is discharged, the separator wings 506 and 508 move outwardly from each other to spread the leg portions 448 of the links which have been advanced out of the receiver breech opening 40 to separate the link from the link belt assembly.

It will be appreciated that the objects of the present invention as set forth above have been accomplished by the construction described, i.e., the dual power cylinder arrangement effectively imposes the operating loads in a symmetrical manner and are disposed in a way such as to minimize the bulk of the weapon, i.e., about a vertical axis so that the width of the weapon is minimized. This allows a relatively slight deflection of the various parts due to the elimination of bending of the parts and due to the division of forces, allowing relatively less bulk in the components.

The use of the high energy spring and the annular weight provides a very effective unloading of the forces on the bolt assembly during unlocking of the bolt to thereby allow the advantages of the spring-extract design without the disadvantages of the relatively high friction forces imposed during unlocking of the bolt assembly.

The manual actuation of the mechanism has been rendered much simpler over the previously disclosed design since only a simple stroking of the manual actuation slider 22 is required with an automatic latching of the bolt in its rearmost position. The capability has also been provided for allowing cessation of fire with the bolt held in the open position by the provision of the mode selector operating the rocker catch such that the bolt would automatically be held retracted to allow ready placement of a fresh ammunition belt.

These improvements have been carried out with a left hand and right hand assembly capability still being afforded by this design specifically by reversing the cam plate on the slide rails, repositioning the trigger plate on the opposite side of the trigger 18, reversing the feed trays, reversing the bolt latching element 204 so that the belt feed may proceed from the opposite direction, and the selector lever will be accessible from the opposite side as well.

The receiver frame 44, together with the slide carriage 166 and associated springs, are reassembled in an inverted position within the housing 12 so as to align the various breech openings correctly. The openings 454 and 456 (FIGS. 11 and 12) accommodate the springs 274 and 276 in this position.

Field stripping is easily executed without the use of tools since the housings merely may be separated by release of suitable mechanical retainers, removal of the locking ring snap retainer 46 allowing the barrel and power cylinder assemblies to be removed from the housings to provide ready access. In addition, a barrel of the same or differing caliber may be quickly substituted, as long as the casing is compatible with the parts of the weapon which engage the cartridge.

It will be also noted that improvements have been made to mechanical aspects of the design over the design described in the aforementioned U.S. Patents. Specifically, the trigger plate is now centrally mounted in the trigger 18 so that during reassembly for either right or left hand operation, it merely need be pivoted about the pedestal 404 to one side or the other of the trigger 18. In addition, the garter spring arrangement disclosed in those patents for returning of the latching element 204 has been replaced with the exterior simpler arrangement of the spring 212 which also simplifies the assembly and machining of the bolt latching element 204.

Many variations of the specific details disclosed are of course possible, since many mechanical equivalents of the various components described could be alternatively incorporated without compromising the basic design.

I claim:

1. In an automatic weapon of the type having an automatically reciprocable bolt adapted to extract ammunition rounds from the chamber and force a new round into the weapon chamber and secure the round against rearward pressures created by firing of said round, said weapon having a mode selector lever movable to positions corresponding to automatic and semi-automatic fire, means for latching said bolt in the rearward position of said bolt after extraction of said ammunition, the improvement comprising:

means responsive to said mode selector lever being in said position corresponding to automatic fire to cause said bolt to be latched in the rearward position upon cessation of fire; and to release said bolt after firing of a round with said mode selector lever in said semi-automatic fire;

selectively operable means including means responsive to said mode selector lever being moved to a release position other than said automatic or semi-automatic fire positions to cause release of said bolt from said latched rearward position to thereby enable manual release of said bolt after cessation of automatic fire.

2. The weapon according to claim 1 further including safety means preventing triggering of said weapon, said safety means responsive to positioning of said mode selector lever in a safety position other than said automatic, semi-automatic, or release positions to prevent triggering of said weapon, and further including means also preventing triggering of said weapon with said mode selector lever in said release position.

* * * * *

UNITED STATES PATENT AND TRADEMARK OFFICE

CERTIFICATE OF CORRECTION

PATENT NO. : 4,450,752

DATED : May 29, 1984

INVENTOR(S) : John S. Donovan

It is certified that error appears in the above-identified patent and that said Letters Patent are hereby corrected as shown below:

Column 3, line 22, "automated" should be --automatic--.

Column 3, line 45, "acts" should be --act--.

Column 3, line 57, "forces" should be --force--.

Column 5, line 14, "throgh" should be --through--.

Column 7, line 54, "the necessary" should be --the forces necessary--.

Column 9, line 50, "while" should be --which--.

Column 19, line 5, "434" should be --432--.

Signed and Sealed this

Ninth Day of April 1985

[SEAL]

*Attest:*

DONALD J. QUIGG

*Attesting Officer* *Acting Commissioner of Patents and Trademarks*